US007300606B2

(12) United States Patent
Chung et al.

(10) Patent No.: US 7,300,606 B2
(45) Date of Patent: Nov. 27, 2007

(54) PB FREE AG PASTE COMPOSITION FOR PDP ADDRESS ELECTRODE

(75) Inventors: Byung-joo Chung, Gyeonggi-Do (KR); Chan-seok Park, Gyeonggi-Do (KR); Seong-mo Park, Gyeonggi-Do (KR); Sin-hye Paek, Gyeonggi-Do (KR)

(73) Assignee: Dongjin Semichem Co., Ltd. (KR)

( * ) Notice: Subject to any disclaimer, the term of this patent is extended or adjusted under 35 U.S.C. 154(b) by 138 days.

(21) Appl. No.: 11/142,012

(22) Filed: Jun. 1, 2005

(65) Prior Publication Data

US 2006/0011895 A1 Jan. 19, 2006

(30) Foreign Application Priority Data

Jun. 1, 2004 (KR) ..... 10-2004-0039623

(51) Int. Cl.

| | |
|---|---|
| ***H01B 1/02*** | (2006.01) |
| ***H01B 1/06*** | (2006.01) |
| ***G03C 1/00*** | (2006.01) |
| ***H01J 17/49*** | (2006.01) |

(52) U.S. Cl. ..... 252/514; 430/281.1; 313/584; 252/511

(58) Field of Classification Search ..... 252/500
See application file for complete search history.

(56) References Cited

U.S. PATENT DOCUMENTS

| | | | | |
|---|---|---|---|---|
| 3,839,384 | A * | 10/1974 | Morehouse | 556/453 |
| 5,851,732 | A * | 12/1998 | Kanda et al. | 430/321 |
| 5,972,564 | A * | 10/1999 | Kawana et al. | 430/281.1 |
| 6,103,452 | A * | 8/2000 | Kakinuma et al. | 430/281.1 |
| 6,132,937 | A * | 10/2000 | Suzuki | 430/285.1 |
| 6,156,433 | A * | 12/2000 | Hatori et al. | 428/411.1 |
| 6,214,527 | B1 * | 4/2001 | Kosaka et al. | 430/319 |
| 6,558,874 | B2 * | 5/2003 | Drozdyk | 430/281.1 |
| 6,793,850 | B2 * | 9/2004 | Ichikawa et al. | 252/511 |
| 6,800,420 | B2 * | 10/2004 | Song et al. | 430/281.1 |
| 6,994,948 | B2 * | 2/2006 | Glicksman et al. | 430/287.1 |
| 7,060,411 | B2 * | 6/2006 | Mitsui et al. | 430/198 |
| 7,135,267 | B2 * | 11/2006 | Yang et al. | 430/198 |
| 7,189,341 | B2 * | 3/2007 | Li et al. | 252/511 |

* cited by examiner

*Primary Examiner*—Douglas McGinty
*Assistant Examiner*—Jaison Thomas
(74) *Attorney, Agent, or Firm*—Cantor Colburn LLP

(57) ABSTRACT

The present invention provides a Pb free Ag paste composition for a PDP address electrode comprising a) 60 to 90% by weight of an Ag powder; b) 1 to 10% by weight of a Pb free inorganic binder; c) 0.001 to 1% by weight of an inorganic thickener; and d) 5 to 38% by weight of an alkali-soluble, negative photoresist composition for fine conductive powder dispersion. The Pb free Ag paste composition according to the invention i) is environment-friendly by using a Pb free inorganic binder, ii) is suitable for the fabrication of fine electrodes by using the prior electrode formation processes, iii) can apply the formed pattern to low temperature sintering processes of not higher than 600° C., iv) does not use a surfactant and stabilizer and has excellent printing, leveling and sintering performances by using an inorganic thickener and conductive Ag powder, and v) enables sintering to be carried out at a sintering target temperature without binder burning off zone.

17 Claims, No Drawings

PB FREE AG PASTE COMPOSITION FOR PDP ADDRESS ELECTRODE

BACKGROUND OF THE INVENTION

1. Field of the Invention

The present invention relates to a Pb free Ag paste composition for a PDP address electrode and more particularly, it relates to an environment-friendly Pb free Ag paste composition for PDP address electrode that can be applied to a low sintering process not higher than 600° C. and exhibits excellent printing, leveling and sintering performances and of which sintering can be carried out at a sintering target temperature without binder burning off zone.

2. Description of Related Art

In recent, in display devices, as demands on large dimension, high density, high precision and high credibility increase, several pattern processing technologies are being developed and also, researches about compositions for the formation of fine electrodes suitable for the various pattern processing technologies are being actively performed.

As plasma display panels (PDP) have quick response rate and are easy to be manufactured to large dimension compared with liquid crystal panels, they are being currently employed in various fields. In order to form electrodes on the PDPs, in general, patterning methods of electrode materials using screen printing have been used. However, the prior screen printing requires delicate skill and due to low viscosity, pastes on substrates may run down during screen printing and precision by screen declines and accordingly, in screen printing, it is difficult to obtain jumbo screen pattern with high precision required for PDPs. Also, in the prior screen printing methods, open or short by screen might be generated during printing and they required high sintering temperature above 1000° C.

Meanwhile, photolithography methods using photoresist resin compositions have been recently developed to form electrode circuits with high precision suitable for large dimension. They are carried out by forming uniform membranes using photoresist resin compositions dispersed with fine conductive powders, exposing the membranes to light using a mask with desired pattern thereon, and developing desired pattern using development solutions. However, as ordinary photoresist conductive pastes are subject to sintering process above 800° C., such methods are not suitable for the fabrication of PDPs where sintering temperature should be kept below 600° C. because sodium carbonate glass is generally used. If sintering is carried out below 600° C., sintering residues are generated and degradation of conductive properties occurs.

Accordingly, to enable low temperature sintering, Ag electrode pastes for PDP address were prepared using inorganic binders containing Pb of more than 60%. However, such Pb containing pastes contain Pb in a high amount, which is difficult to be recovered after use and hardly degraded in natural conditions due to the inherent characteristics of Pb and accordingly, they may have a serious influence on animals and plants and globe environments.

Although researches about Pb free pastes are in progress to solve such problems, prior Pb free pastes have a sintering temperature above 600° C. Also, as holes are enlarged after sintering, sintering is not completed, and as the organic materials of the photoresist compositions that are not completely removed remain carbonized, Ag powders may not be completely sintered thereby raising electric resistance as an insulator after sintering process and may still create fine cracks on pattern after fine pattern is formed after sintering.

Accordingly, in the prior sintering processes, they were kept for 30 to 60 min. at 350° C. before they reached sintering temperature to burn off the organic materials of the photoresist compositions. In other words, in the prior arts, binder burning off zone existed to eliminate the causes bringing about the decrease of the sintering properties such as sintering densification decrease and fine crack formation by the organic materials of the remaining photoresist compositions after sintering, but it resulted in extended sintering time.

SUMMARY OF THE INVENTION

Therefore, to solve the aforementioned problems, the present invention is intended to provide a Pb free Ag paste composition for a PDP address electrode, i) which is environment-friendly by using a Pb free inorganic binder, ii) which is suitable for the fabrication of fine electrodes by using the prior electrode formation processes, iii) which can apply the formed pattern to low temperature sintering processes of not higher than 600° C., iv) which does not use a surfactant and stabilizer and has excellent printing, leveling and sintering performances by using an inorganic thickener and conductive Ag powder, and v) of which sintering can be carried out at a sintering target temperature without binder burning off zone.

To achieve the objects, an embodiment of the invention provides a Pb free Ag paste composition for a PDP address electrode comprising:

a) 60 to 90% by weight of an Ag powder;

b) 1 to 10% by weight of a Pb free inorganic binder;

c) 0.001 to 1% by weight of an inorganic thickener; and d) 5 to 38% by weight of an alkali-soluble, negative photoresist composition for fine conductive powder dispersion.

The invention also provides a PDP address electrode prepared using the Pb free Ag paste composition.

DETAILED DESCRIPTION OF THE INVENTION

The invention is further described in detail.

The Pb free Ag paste composition for a PDP address electrode according to the present invention comprises a) 60 to 90% by weight of an Ag powder; b) 1 to 10% by weight of a Pb free inorganic binder; c) 0.001 to 1% by weight of an inorganic thickener; and d) 5 to 38% by weight of an alkali-soluble, negative photoresist composition for fine conductive powder dispersion.

The amount of the Ag powder is 60 to 90% by weight, preferably 60 to 75% by weight, more preferably 65 to 75% by weight. When the amount of the Ag powder is less than 60% by weight, due to the low density of the Ag powder, pores on the surface increase, electric resistance is raised and open may be generated after pattern formation and sintering process, and due to lowered viscosity, it might run down on glass substrates during printing process. Further, as pattern is too hardened after exposure to light, pattern may be torn off during development and as a result, the straightness of pattern may decrease. When the amount of the Ag powder exceeds 90% by weight, due to excessively high viscosity, it may not be printed on glass substrates, and due to decreased flatness after printing, it may cause partial unequal thickness and mesh trace of screen mask, thereby deteriorating a surface configuration. Also, due to insufficient photoresist organic vehicles, light may not be reached to glass substrates during exposure, thereby increasing under cut phenomena.

Ag powders of any shapes can be used as the Ag powder but in consideration of dispersion, it is preferable to use a sphere particle, and in case that the particle is a perfect sphere, it possesses more enhanced dispersion and it is thus advantageous for the preparation of paste.

Preferably, the Ag powder has an average diameter ($D_{50}$) of 0.5 to 3 μm and a maximum diameter ($D_{max}$) of 3 to 5 μm. If the maximum diameter of the Ag powder exceeds 5 μm, it is not advisable because straightness decreases after development.

Although the Ag powder that is not treated with a dispersant can be used, it is preferable to be treated with the dispersant to enhance its dispersion. Its purity is preferably not less than 96%, more preferably not less than 98%. If the purity is low, electric resistance may be raised due to impurities after sintering process.

The tap density of the Ag powder is 3.0 to 5.0 g/cm$^3$, preferably 4.0 to 5.0 g/cm$^3$, more preferably 4.3 to 5.0 g/cm$^3$. When the tap density is within the above ranges, excellent ultraviolet penetration is achieved and the precision of electrode pattern is improved. Also, by using the Ag powder having the tap density within the above ranges, a minute membrane with good leveling performance as a coating membrane after paste printing can be easily obtained.

As mentioned above, the invention uses a Pb free inorganic binder to prepare an environment-friendly Ag paste composition.

The amount of the Pb free inorganic binder is 1 to 10% by weight, preferably 2 to 6% by weight. When the amount of the Pb free inorganic binder is less than 1% by weight, adhesion to glass substrates after sintering is decreased and thus there is a risk that electrodes might be lifted up. When it exceeds 10% by weight, the electric resistance of the electrodes may be decreased after sintering or there is a risk of open, and the electrodes may run down.

Particularly, the Pb free inorganic binder used in the invention is selected from the group consisting of $Bi_2O_3$, $SiO_2$, $B_2O_3$, $ZrO_2$, $Al_2O_3$ and combination thereof and it is preferred that it does not contain $Na_2O$, $K_2O$, $Li_2O$ or PbO. The inorganic binder of the invention enables the preparation of the stable pastes capable of overcoming the problem that pattern is not formed due to viscosity increase, etc. not by containing $Na_2O$, $K_2O$, $Li_2O$ or PbO, and it has the advantage that it inhibits the diffusion of electrodes and dielectrics after sintering.

Preferably, the Pb free inorganic binder has a glass transition temperature ($T_g$) of 350 to 500° C. and a glass softening temperature ($T_s$) of 400 to 500° C. When $T_g$ and $T_s$ a less than the aforementioned ranges, the sintering process of the inorganic binders commences under the conditions that organic materials are not completely degraded and thus the organic materials that are not eliminated are present in the pattern. When $T_g$ and $T_s$ exceed the aforementioned ranges, adhesion to glass substrates is decreased due to incomplete sintering, holes might be generated on pattern surface after sintering, and electric resistance may be increased.

As the Pb free inorganic binder is obtained by pulverization, its particle shape is not sphere, and in case that the particles are evenly distributed, the precision of pattern is improved. If the particles are agglomerated, it is not advantageous in that straightness is decreased after pattern formation and the shape of the particles may be maintained after sintering. Accordingly, the particle size distribution of the binder is an important factor.

In general, it is preferable to select the Pb free inorganic binder so as to have the same particle size distribution as the Ag particles. However, if the inorganic binder has the same distribution as the Ag particles, there is a possibility that cavity is formed after sintering and accordingly, it is, in fact, preferable to have a size that can be included into Ag particle gaps. Hence, it is preferred that the average diameter ($D_{50}$) is 0.5 to 3.0 μm and the maximum diameter ($D_{max}$) is 3 to 5 μm, or more preferably, the average diameter is 0.5 to 1.5 μm and the maximum diameter is not more than 3 μm.

When the Pb free inorganic binder is stored, it is advisable to store it in places absent in moisture. This is because moisture can accelerate the gelation of the paste when it is absorbed to the inorganic binder. Accordingly, for example, it is preferable to dry the inorganic binder at the temperature between 80 and 300° C., which is about 100° C. lower than $T_g$ thereby eliminating the moisture and impurities absorbed to the inorganic binder surface. At the temperature above 350° C., the inorganic binder may lose its powder shape because it exceeds its transition temperature and thus can be no more used for the preparation of pastes, and it may also lose its inherent characteristics due to crystallization.

The Pb free Ag paste composition for PDP address electrode according to the invention comprises an inorganic thickener in an amount of 0.001 to 1% by weight. The inorganic thickener is used to control the viscosity of the paste and there are used non-crystalline materials that do not exercise bad influences on the stability and sintering performances of the paste. As the type of the inorganic thickener used in the invention, there are aqueous and non-aqueous inorganic thickeners, and it is not limited to, but can be selected from the group consisting of silica, kaolin, alumina, and combination thereof.

The Pb free Ag paste composition for PDP address electrode according to the invention comprises 5 to 38% by weight of an alkali-soluble, negative photoresist composition for fine conductive powder dispersion.

The alkali-soluble, negative photoresist composition for fine conductive powder dispersion comprises a) 5 to 50% by weight of an acrylate copolymer for photoresist represented by formula 1:

1

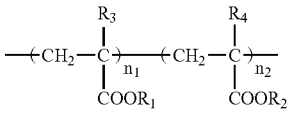

wherein $R_1$ is a hydrogen, phenyl group, phenyl group substituted with nitro group, phenyl group substituted with halogen, benzyl group substituted with nitro group, C1 to C10 alkyl group which may contain an unsaturated group or unsaturated carbon, or C1 to C10 alkyl group substituted with hydroxy group; $R_2$ is an alkyl group selected from the group consisting of ethylhexyl group, isobutyl group, tert-butyl group and octyl group, 3-methoxy butyl group, or methoxy propylene glycol group; $R_3$ is a hydrogen or alkyl group; $R_4$ is a hydrogen or alkyl group; and $n_1$ and $n_2$ are an integer of 1 to 120, or formula 2:

2

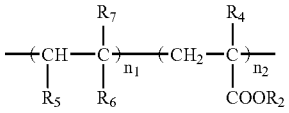

wherein $R_5$ is a hydrogen or carboxyl group; $R_6$ is a phenyl group, carboxyl group, or —$OCOCH_3$ group; $R_7$ is a hydrogen or —$CH_2COOH$ group; and $R_2$, $R_4$, $n_1$, and $n_2$ are the same as defined in formula 1;

b) 5 to 40% by weight of a photopolymerizable monomer;

c) 5 to 20% by weight of a photopolymerization initiator;

d) 5 to 10% by weight of a defoamer;

e) 4.5 to 30% by weight of a leveling agent;

f) 0.5 to 10% by weight of a plasticizer; and g) 30 to 60% by weight of a solvent.

The amount of the alkali-soluble, negative photoresist composition for fine conductive powder dispersion is 5 to 38% by weight. When the amount of the photoresist composition exceeds 38% by weight, it is undesirable because electrode resistance is increased due to the presence of pores inside electrodes when the electrodes are formed and thus electrode open is likely to be generated during circuit operation. When the amount is less than 5% by weight, it is difficult to obtain desirable electrode pattern.

The acrylate copolymer of the formula 1 or 2 has preferably a viscosity of 1500 to 40000 cP and a molecular weight of 5000 to 50000, more preferably 7000 to 12000. Also, the polymers having a glass transition temperature of not lower than 80° C. are suitable for printing methods, and if the glass transition temperature is lower than 80° C., it may be problematic owing to strong adhesion during printing.

The monomers used to prepare the acrylate copolymer include unsaturated carboxylic acids, aromatic monomers, monomers with their own plasticity and acryl monomers excluding the monomers with their own plasticity.

The unsaturated carboxylic acids are used for alkali solubility and particularly, include acrylic acid, methacrylic acid, itaconic acid, maleic acid, fumaric acid, vinyl acetate and acid anhydrides thereof. The amount of the unsaturated carboxylic acids is preferably 20 to 50% by weight of the polymer composition. When the amount of the unsaturated carboxylic acid exceeds 50% by weight, gelation may easily occur during polymerization, it is difficult to control degree of polymerization and preservation stability of photoresist resin composition is degraded. Also, when the amount of the unsaturated carboxylic acid is less than 20% by weight, time required for development is extended.

The aromatic monomers are used for stable pattern formation and adhesion to glass face during development. As the examples of the aromatic monomers, there can be mentioned styrene, benzylmethacrylate, benzylacrylate, phenylacrylate, phenylmethacrylate, 2 or 4-nitrophenylacrylate, 2 or 4-nitrophenylmethacrylate, 2 or 4-nitrobenzylmethacryl 2 or 4-chlorophenylacrylate, 2 or 4-chlorophenylmethacrylate and so on. The amount of the aromatic monomers is preferably 15 to 45% by weight of the polymer composition, more preferably 20 to 40% by weight. If the amount of the aromatic monomers exceeds 45% by weight, time required for development is extended, and heat resistance is increased and as a result, photoresist resin is not eliminated during sintering process and remains thereby causing serious problems such as lowering the inherent characteristics of electrodes. Also, if the amount of the aromatic monomer is less than 15% by weight, adhesion to glass face is decreased during development process thereby deteriorating tear-off phenomena of pattern and the straightness of the formed pattern is degraded thereby making difficult the expression of stable pattern.

The monomers having their own plasticity have a role in controlling the degree of the polymerization of the polymer and weakening its crystality. As the examples of the monomers having their own plasticity, there can be mentioned 2-ethylhexyl(meth)acrylate, isobutyl(meth)acrylate, tert-butyl(meth)acrylate, octyl(meth)acrylate, 3-methoxybutyl (meth)acrylate, methoxypropyleneglycol(meth)acrylate and so on. The amount of the monomers having their own plasticity is preferably 3 to 15% by weight of the polymer composition, more preferably 5 to 10% by weight. If the amount of the monomers having their own plasticity exceeds 15% by weight, tear-off phenomena of pattern is deteriorated during development process and the straightness of the formed pattern is degraded. If the amount of the monomers having their own plasticity is less than 3% by weight, the degree of polymerization is increased, thereby causing gelation and in case of the polymers that are not gelated, the pattern formed after development process can be easily damaged.

Further, the acryl monomers excluding the acryl monomers having their own plasticity control the glass transition temperature of the polymer, adhesion to substrates and polarity. As the examples of such acryl monomers, there are 2-hydroxyethyl(meth)acrylate, 2-hydroxyoctyl(meth)acrylate, methyl(meth)acrylate, ethyl(meth)acrylate, n-butylacrylate and so on. The amount of such monomers in the polymer is preferably 10 to 30% by weight of the polymer composition in consideration of the glass transitions and heat resistance of the polymer, hydrophilicity to development solutions.

The acrylate copolymer can be obtained by polymerizing the four kinds of the monomers in solvents with suitable polarity capable of preventing their gelation. Preferably, for the solvents, there can be used carbitolacetate, gammabutyrolactone, diethyleneglycolbutylether, trimethylpentanediolmonoisobutyrate, dipropyleneglycolmonoethylether and so on.

The amount of the acrylate copolymer resin of formula 1 or 2 is 1 to 50% by weight. If the amount of the copolymer is less than 5% by weight, pattern formation is problematic and if it exceeds 50% by weight, it has problems with the expression of the characteristics of dispersion powder.

For the photopolymerization initiator in the photoresist composition, triazine, benzophenone, acetophenone, imidazole, thioxanthone compounds can be used alone or in a mixture thereof. As specific examples, there are 2,4-bistrichloromethyl-6-p-methoxystyryl-s-triazine, 2-p-methoxystyryl-4,6-bistrichloromethyl-s-triazine, 2,4-trichloromethyl-6-triazine, 2,4-trichloromethyl-4-methylnaphthyl-6-triazine, benzophenone, p-(diethylamino)benzophenone, 2,2-dichloro-4-phenoxyacetophenone, 2,2'-diethoxyacetophenone, 2,2'-dibutoxyacetophenone, 2-hydroxy-2-methylproliophenone, p-t-butyltrichloroacetophenone, p-t-butyldichloroacetophenone, benzyldimethylketal, 4,4'-ethylaminobenzophenone, 2-methyl-1-4-methylthiophenyl-2-4-morpholinyl-1-propanone, 2-benzyl-2-dimethylamino-1-4-4'morpholinylphenyl-1-butanone, 2,4,6-trimethyl benzoyl, thioxanthone, 2-chlorothioxanthone, 2-methylthioxanthone, 2-isobutylthioxanthone, 2-dodecylthioxanthone, isopropyl-9H-thioxanthone, 2,4-dimethylthioxanthone and 2,4-diethylthioxanthone-2,2'-bis-2-chlorophenyl- 4,5,4',5'-tetraphenyl-2'-1,2'-biimidazole. The amount of the photopolymerization initiator is preferably 5 to 20% by weight, more preferably 5 to 15% by weight. If the amount of the photopolymerization initiator exceeds 20% by weight, it may have preservation stability problems and due to high degree of hardening, peeling of pattern may be deteriorated during development. On the other hand, if it is less than 5% by weight, it is difficult to express normal pattern due to low sensitivity and also, it adversely affects the straightness of pattern.

For the photopolymerizable monomer in the photoresist composition, one or more multifunctional acrylate derivatives can be used. As specific examples, there are butanediol diacrylate, triethyleneglycol diacrylate, 1,4-butanediol diacrylate, 1,3-butyleneglycol diacrylate, 1,6-hexanediol diacrylate, ethyleneglycol diacrylate, diethyleneglycol diacrylate, trimethylpropane triacrylate (TMPTA), tripropyleneglycol diacrylate (TPGDA), tetraethyleneglycol diacrylate (TTEGDA), trimethylpropane ethoxytriacrylate (TMPEOTA), polyethyleneglycol diacrylate, dipentaerythritolkisaacrylate, dipentaerythritol hydroxypentacrylate, glycerol diacrylate, trimethyolpropane trimethacrylate, pentaerythritol trimetharcylate, pentaerythritol dimethacrylate, sorbitol trimethacrylate, bisphenol A diacrylate derivative, trimethylolpropane triacrylate and dipentaerythritol polyacrylate. The amount of the photopolymerizable monomer is preferably 5 to 40% by weight, more preferably 8 to 20% by weight. If the amount of the photopolymerizable monomer exceeds 40% by weight, due to high degree of hardening, tear-off phenomena of pattern is deteriorated during development and the straightness of pattern is decreased, and if it is less than 5% by weight, due to low sensitivity and degree of hardening, it is difficult to express normal pattern and the straightness of pattern is deteriorated.

In the photoresist composition, the defoamer prevents microbubbles which are generated in its mixing stage with Ag powders during coating based on printing methods and exist in membranes due to high viscosity, from inducing the open of electrodes by change to pinholes during sintering process. The leveling additive inhibits the decrease of the miscibility of the Ag powders and photoresist composition due to the surface tension of the photoresist composition and reduces inferiority that can be generated from uneven membranes.

As specific examples, for the leveling agent, there are anionic copolymers, aralkyl modified polymethylalkylsiloxane compounds and so on, and for the defoamer, there are polyester modified polymethylalkylsiloxane, polysiloxane, non-silicone polymer compound, modified urea solution, polyester modified dimethylpolysiloxane, polyester modified dimethylpolysiloxane copolymer and so on. The amount of the defoamer and leveling agent is preferably 5 to 10% by weight and 4.5 to 30% by weight respectively. When the amount of the defoamer and leveling agent exceeds the above ranges, residual layers are likely to remain during development process and when it is less than the above ranges, it is difficult to obtain desirable characteristics.

The plasticizer in the photoresist composition can be selected from the group consisting of paraffin oil, dioctylphthalate, dibutoxyethyl phthalate, tricrysylphosphate, dioctylcebacate, triphenylphosphate, chlorinated biphenyl, dihexylphthalate, hydro terphenyl, dibutylphthalate, dipropylphthalate, diethylphthalate, dimethylphthalate, santicizer, glycerin, and combination thereof, and its amount is preferably 0.5 to 10% by weight, more preferably 1 to 5% by weight. When the amount of the plasticizer exceeds 10% by weight, it decreases the characteristics of the acrylate copolymer resin and when it is less than 0.5% by weight, it is difficult to obtain desirable characteristics.

The photoresist composition according to the present invention may further a dispersant in an amount of not more than 3% by weight. If the amount of the dispersant exceeds 3% by weight, problems such as residual layers, residues, decrease of viscosity and phase separation may occur.

The photoresist composition according the invention comprises 30 to 60% by weight of a solvent. The solvent is not limited to, but includes carbitolacetate, gammabutyrolactone, diethyleneglycol monobutylether, diethyleneglycol monobutyletheracetate, trimethylpentanediol monoisobutyrate, dipropyleneglycol monoethylether, methylcelosolv, ethylcelosolv, butylcelosolv, methylethylketone, dioxane, acetone, cyclohexanone, cyclopentanone, isobutyl alcohol, isopropyl alcohol, tetrahydrofuran and so on. The organic solvent can be used alone or in a mixture thereof. When the amount of the solvent is less than 30% by weight, the flow performance of the paste is decreased and when it exceeds 60% by weight, the paste may run down during printing process due to low viscosity and phase separation may occur.

The Pb free Ag paste composition according to the present invention is prepared by mixing the Ag powder, Pb free inorganic binder, inorganic thickener and alkali-soluble negative photoresist composition for fine conductive powder dispersion as described above, carrying out pre-mixing for example using a planetary mixer, and evenly dispersing the Ag powder, Pb free inorganic binder and inorganic thickener to the photoresist composition using a pulverizer such as a 3-roll mill thereby forming paste phase. The paste composition prepared above has a viscosity 3000 to 60000 cP and pseudoplastic behavior. By possessing such pseudoplastic behavior, it has low resistance against strain applied during printing and accordingly, printing performance is enhanced in spite of high viscosity. Also, it is possible to have high flatness after printing and it can prevents metal powders, inorganic powders and organic powders from being separated during storage.

Another embodiment of the invention provides a PDP address electrode prepared using the Pb free Ag paste composition according to the invention. The electrode is prepared by fine pattern formation and sintering process.

The fine pattern is formed by printing the Ag paste composition prepared above on the surface of a substrate using a screen printer with a screen mask such as SUS 325 mesh or SUS 400 mesh, drying the coated specimen in a convection oven or IR oven at a temperature of 90 to 140° C. for 10 to 20 min., exposing light of 325 mm over the formed Ag paste coating membrane using a suitable light source so as to form pattern, and developing it with suitable alkali development solutions such as $NaCO_3$ solution, KOH, TMA II and the like at a temperature around 30° C.

Also, the sintering process is carried out by sintering the fine pattern formed above at 500 to 600° C. for example, in an electric furnace, for 10 to 30 min.

The invention is further described by way of Examples in detail. It should be understood, however, that the scope of the invention is not restricted to the following examples. Unless otherwise mentioned, numerals used in the following Examples represent percent by weight.

EXAMPLES

Performance Test According to the Amount of Ag powder and the Type of Inorganic Binders The average diameter of the Ag powder used herein was 1.2 μm, for the inorganic binder there were used Pb free binders according to the invention and Pb containing binders as comparative examples, phosphorous acid was used as a stabilizer, the photoresist composition comprised 27% by weight of acryl copolymer, 12% by weight of photopolymerization monomer, 9% by weight of photopolymerization initiator, 42% by weight of solvent and 10% by weight of other additives. Development performance, pattern formation thickness, thickness after development, thickness after sintering, viscosity, and presence of gelation as an indicator of preservation stability were evaluated with regard to each paste of Examples and Comparative Examples and the results are shown in Table 1 below.

TABLE 1

| | | Ex. 1 | Com. Ex. 1 | Com. Ex. 2 | Ex. 2 | Com. Ex. 3 | Com. Ex. 4 |
|---|---|---|---|---|---|---|---|
| Ag powder | | 70 | 70 | 70 | 75 | 75 | 75 |
| Inorganic | Pb free | 3 | — | — | 3 | — | — |
| binder | Pb containing | — | 2.95 | 3 | — | 2.95 | 3 |
| Stabilizer | | | 0.05 | — | | 0.05 | — |
| Photoresist composition | | 27 | 27 | 27 | 22 | 22 | 22 |
| Development | | Good | Good | Good | Good | Good | Good |
| Pattern formation (μm) | | 50 | 50 | 50 | 50 | 50 | 50 |
| Thickness after development (μm) | | 8 | 11 | 11 | 10 | 13 | 13 |
| Thickness after sintering (μm) | | 4 | 5.5 | 5.5 | 5 | 7.5 | 7.5 |
| Viscosity (cP) | | 22000 | 15000 | 15000 | 30000 | 19000 | 19000 |
| Gelation and preservation stability | | | | Gelated | | | Gelated |

As can be seen from Table 1 above, all of the cases that the amount of the Ag powder was 70% by weight (Example 1, Comparative Examples 1 and 2) and 75% by weight (Example 2, Comparative Examples 3 and 4) had excellent development performances, viscosity ranges with pseudoplastic characteristics and good pattern thickness after sintering. However, when the Pb containing inorganic binder was used (Comparative Examples 1, 2, 3 and 4), gelation did not occur in case of addition of stabilizer (Comparative Examples 1 and 3) but, in case that the stabilizer was not added (Comparative Examples 2 and 4), gelation occurred and thus preservation stability was not good.

EXAMPLES

Performance Test According to Tg of Inorganic Binder

Using inorganic binders having Tg of 560□, 460□ and 360□ respectively, sintering performance according to $T_g$ of the inorganic binder was tested with regard to the compositions of above Examples 1 and 2 and Comparative Example 1, and the results are shown in Table 2 below.

TABLE 2

| | | Com. Ex. 1 | Ex. 1 | Ex. 2 |
|---|---|---|---|---|
| Ag powder | | 70 | 70 | 70 |
| Inorganic | $T_g$ 560° C. | 3 | — | — |

TABLE 2-continued

| | | Com. Ex. 1 | Ex. 1 | Ex. 2 |
|---|---|---|---|---|
| binder | $T_g$ 460° C. | — | 3 | — |
| | $T_g$ 360° C. | — | — | 3 |
| Photoresist composition | | 27 | 27 | 27 |
| Development | | Good | Good | Good |
| Pattern formation (μm) | | 50 | 50 | 50 |
| Curling | 550° C. sintering | Not less than 10 | Not more than 1.5 | 0 |
| | 580° C. sintering | Not less than 8 | Not more than 1.5 | 0 |

As can be seen from Table 2 above, in the test according to the Tg of the inorganic binder, sintering performance showed big difference. Curling phenomena where due to the lack of adhesion to glass substrates which occurs after sintering, the permittivity of dielectrics is decreased in the subsequent processes, were noticeably shown at the low sintering temperature in the inorganic binder having high Tg. On the other hand, in case of the inorganic binder having low Tg, curling phenomena did not happen or had only minor value at the low sintering temperature.

According to the invention, there can be provided a Pb free Ag paste composition for a PDP address electrode i) which is environment-friendly by using a Pb free inorganic binder, ii) which is suitable for the fabrication of fine electrodes by using the prior electrode formation processes, iii) which can apply the formed pattern to low temperature sintering processes of not higher than 600° C., iv) which does not use a surfactant and stabilizer and has excellent printing, leveling and sintering performances by using an inorganic thickener and conductive Ag powder, and v) of which sintering can be carried out at a sintering target temperature without binder burning off zone.

What is claimed is:

1. A Pb free Ag paste composition for a PDP address electrode comprising:

a) 60 to 90% by weight of an Ag powder;

b) 1 to 10% by weight of a Pb free inorganic binder;

c) 0.001 to 1% by weight of an inorganic thickener; and d) 5 to 38% by weight of an alkali-soluble, negative photoresist composition for fine conductive powder dispersion comprising i) 5 to 50% by weight of an acrylate copolymer for photoresist, having a molecular weight of 5,000 to 50,000, and represented by formula 1:

1

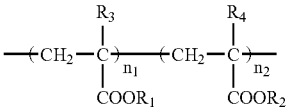

wherein $R_1$ is a hydrogen, phenyl group, phenyl group substituted with nitro group, phenyl group substituted with halogen, or benzyl group substituted with nitro group; $R_2$ is an alkyl group selected from the group consisting of ethylhexyl group, isobutyl group, tert-butyl group or octyl group; $R_3$ is a hydrogen or alkyl group; $R_4$ is a hydrogen or alkyl group; and $n_1$ and $n_2$ are an integer of 1 to 120, or formula 2:

2

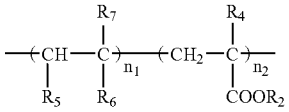

wherein $R_5$ is a hydrogen or carboxyl group; $R_6$ is a phenyl group, or carboxyl group; $R_7$ is a hydrogen or —$CH_2COOH$ group; and $R_2$, $R_4$, $n_1$, and $n_2$ are the same as defined in formula 1; and where the acrylate polymer comprises A.) 20 to 50% by weight of an unsaturated carboxylic acid, B.) 15 to 45% by weight of an aromatic monomer, C.) 3 to 15% by weight of monomers having their own plasticity, D.) 10 to 30% by weight of acryl monomers excluding acryl monomers having their own plasticity, where the amount of each monomer is by weight of the acrylate polymer;

ii) 5 to 40% by weight of a photopolymerizable monomer;

iii) 5 to 20% by weight of a photopolymerization initiator;

iv) 5 to 10% by weight of a defoamer;

v) 4.5 to 30% by weight of a leveling agent;

vi) 0.5 to 10% by weight of a plasticizer; and vii) 30 to 60% by weight of a solvent wherein the Ag paste composition has a viscosity of 3000 to 60000 cP.

2. The Pb free Ag paste composition of claim 1 wherein the Ag powder has a particle shape of sphere.

3. The Pb free Ag paste composition of claim 1 wherein the Ag powder has an average diameter (D50) of 0.5 to 3 μm and a maximum diameter ($D_{max}$) of 3 to 5 μm.

4. The Pb free Ag paste composition of claim 1 wherein the purity of the Ag powder is not less than 96%.

5. The Pb free Ag paste composition of claim 1 wherein the tap density of the Ag powder is 4.3 to 5.0 g/cm$^3$.

6. The Pb free Ag paste composition of claim 1 wherein the Pb free inorganic binder is selected from the group consisting of $Bi_2O_3$, $SiO_2$, $B_2O_3$, $ZrO_2$, $Al_2O_3$ and combination thereof and does not contain $Na_2O$, $K_2O$, $Li_2O$ or PbO.

7. The Pb free Ag paste composition of claim 1 wherein the Pb free inorganic binder has a glass transition temperature of 350 to 500° C. and a glass softening temperature of 400 to 500° C.

8. The Pb free Ag paste composition of claim 1 wherein the Pb free inorganic binder has an average diameter ($D_{50}$) of 0.5 to 3 μm and a maximum diameter ($D_{max}$) of3 to 5 μm.

9. The Pb free Ag paste composition of claim 1 wherein the Pb free inorganic binder is dried at a temperature between 80 and 300° C., which is 100° C. lower than the glass transition temperature of the inorganic binder.

10. The Pb free Ag paste composition of claim 1 wherein the inorganic thickener is selected from the group consisting of silica, kaolin, alumina, mica and combination thereof.

11. The Pb free Ag paste composition of claim 1 wherein the alkali-soluble, negative photoresist composition for fine conductive powder dispersion further comprises a dispersant in an amount not more than 3% by weight.

12. The Pb free Ag paste composition of claim 1 wherein the photopolymerizable monomer is selected from the group consisting of butanediol diacrylate, triethyleneglycol diacrylate, 1,4-butanediol diacrylate, 1,3-butyleneglycol diacrylate, 1,6-hexanediol diacrylate, ethyleneglycol diacrylate, diethyleneglycol diacrylate, trimethylpropane triacrylate (TMPTA), tripropyleneglycol diacrylate (TPGDA), tetraethyleneglycol diacrylate (TTEGDA), trimethylpropane ethoxytriacrylate (TMPEOTA), polyethyleneglycol diacrylate, dipentaerythritolkisaacrylate, dipentaerythritol hydroxypentacrylate, glycerol diacrylate, trimethyolpropane trimethacrylate, pentaerythritol trimetharcylate, pentaerythritol dimethacrylate, sorbitol trimethacrylate, bisphenol A diacrylate derivative, trimethylolpropane triacrylate, dipentaerythritol polyacrylate, and combination thereof.

13. The Pb free Ag paste composition of claim 1 wherein the photopolymerization initiator is selected from the group consisting of 2,4-bistrichloromethyl-6-p-methoxystyryl-s-triazine, 2-p-methoxystyryl-4,6-bistrichloromethyl-s-triazine, 2,4-trichloromethyl-6-triazine, 2,4-trichloromethyl-4-methylnaphthyl-6-triazine, benzophenone, p-(diethylamino) benzophenone, 2,2-dichloro-4-phenoxyacetophenone, 2,2'-diethoxyacetophenone, 2,2'-dibutoxyacetophenone, 2-hydroxy-2-methylproliophenone, p-t-butyltrichloroacetophenone, p-t-butyldichloroacetophenone, benzyldimethylketal, 4,4'-ethylaminobenzophenone, 2-methyl-1-4-methylthiophenyl-2-4-morpholinyl-1-propanone, 2-benzyl-2-dimethylamino- 1-4-4'morpholinylphenyl-1-butanone, 2,4,6-trimethyl benzoyl, thioxanthone, 2-chlorothioxanthone, 2-methylthioxanthone, 2-isobutylthioxanthone, 2-dodecylthioxanthone, isopropyl-9H-thioxanthone, 2,4-dimethylthioxanthone, 2,4-diethylthioxanthone-2,2'-bis-2-chlorophenyl-4,5,4', 5'-tetraphenyl-2'-1,2'-biimidazole, and combination thereof.

14. The Pb free Ag paste composition of claim 1 wherein the leveling agent is an anionic copolymer or aralkyl modified polymethylalkylsiloxane compound, and the defoamer is selected from the group consisting of polyester modified polymethylalkylsiloxane, polysiloxane, non-silicone polymer compound, modified urea solution, polyester modified dimethylpolysiloxane, polyester modified dimethylpolysiloxane copolymer, and combination thereof.

15. The Pb free Ag paste composition of claim 1 wherein the plasticizer is selected from the group consisting of paraffin oil, dioctylphthalate, dibutoxyethyl phthalate, tricrysylphosphate, dioctylcebacate, triphenylphosphate, chlorinated biphenyl, dihexylphthalate, hydro terphenyl, dibutylphthalate, dipropylphthalate, diethylphthalate, dimethylphthalate, santicizer, glycerin, and combination thereof.

16. The Pb free Ag paste composition of claim 1 wherein the solvent is selected from the group consisting of carbitolacetate, gammabutyrolactone, diethyleneglycol monobutylether, diethyleneglycol monobutyletheracetate, trimethylpentanediol monoisobutyrate, dipropyleneglycol monoethylether, methylcelosolv, ethylcelosolv, butylcelosolv, methylethylketone, dioxane, acetone, cyclohexanone, cyclopentanone, isobutyl alcohol, isopropyl alcohol, tetrahydrofuran, and combination thereof.

17. A PDP address electrode prepared using the Pb free Ag paste composition according to claim 1.

* * * * *